United States Patent [19]

Hatch

[11] 4,397,264

[45] Aug. 9, 1983

[54] ELECTROSTATIC IMAGE DEVELOPMENT SYSTEM HAVING TENSIONED FLEXIBLE RECORDING MEMBER

[75] Inventor: Gilbert J. Hatch, Rochester, N.Y.

[73] Assignee: Xerox Corporation, Stamford, Conn.

[21] Appl. No.: 169,543

[22] Filed: Jul. 17, 1980

[51] Int. Cl.[3] ..... G03G 15/09

[52] U.S. Cl. ..... 118/656; 118/657; 118/638; 118/33

[58] Field of Search ..... 118/656, 657, 649, 653, 118/638, 33

[56] References Cited

U.S. PATENT DOCUMENTS 4,013,041 3/1977 Anderson ..... 118/656

OTHER PUBLICATIONS

Swapceinski, Research Disclosure J., Jul. 1979, p. 352, No. 18318.

*Primary Examiner*—John D. Welsh

*Attorney, Agent, or Firm*—H. Fleischer; H. M. Brownrout

[57] ABSTRACT

An apparatus in which a developer roller transports insulating developer material into contact with a flexible member in a development zone so as to develop a latent image recorded thereon. The flexible member is maintained at a preselected tension. In this way, the developer material being transported into contact with the latent image spaces the flexible member from the developer roller. The thickness of the layer of developer material on the developer roller is adjustable to control the spacing between the flexible member and the developer roller. In this way, development of solid areas and lines in the latent image may be optimized.

8 Claims, 4 Drawing Figures

ELECTROSTATIC IMAGE DEVELOPMENT SYSTEM HAVING TENSIONED FLEXIBLE RECORDING MEMBER

The invention relates generally to an electrophotographic printing machine, and more particularly concerns an apparatus for developing a latent image.

Generally, an electrophotographic printing machine includes a photoconductive member which is charged to a substantially uniform potential to sensitize the surface thereof. A charged portion of the photoconductive surface is exposed to a light image of an original document being reproduced. This records an electrostatic latent image on the photoconductive member corresponding to the informational areas contained within the original document. After the electrostatic latent image is recorded on the photoconductive member, the latent image is developed by bringing a developer material into contact therewith. This forms a powder image on the photoconductive member which is subsequently transferred to a copy sheet. Finally, the copy sheet is heated to permanently affix the powder image thereto in image configuration.

Frequently, the developer material is made from a mixture of carrier granules and toner particles. The toner particles adhere triboelectrically to the carrier granules. This two-component mixture is brought into contact with the latent image. Toner particles are attracted from the carrier granules to the latent image forming the powder image thereof. Hereinbefore, it has been difficult to develop both the large solid areas of the latent image and the fine lines thereof. In general, most electrophotographic printing machines employ a magnetic brush development system for developing the latent image. Magnetic brush development systems employ either a conductive developer material or insulating developer material. The conductive magnetic brush development system and the insulating magnetic brush development system suffer from limitations in their abilities to meet the full range of copy quality requirements. Specifically, insulating magnetic brush development systems have difficulty in using one developer roller to develop both fine lines and solid areas. In order to optimize solid area development with an insulating developer material, the spacing between the developer roller and photoconductive surface must be made quite small. However, low density fine line development occurs at a larger spacing to take advantage of the accuracy of fringe field development with insulating materials. This permits development with high cleaning fields so as to minimize background development. Hereinbefore, several developer rollers were required to achieve these results. However, the utilization of additional developer rollers increases the cost of the development system. Conductive magnetic brush development systems inherently fail to faithfully reproduce low density lines. Conductive developer materials are not sensitive to fringe fields. In order to achieve low density fine line development with conductive developer materials, the cleaning field must be relatively low. This produces relatively high background. Thus, in both of the foregoing systems there continues to exist the problem of achieving uniform development for both fine lines and large solid areas in electrostatic latent images. It has been extremely difficult to completely develop both the fine line image areas as well as the large solid areas while maintaining a minimum background density. Development can be improved by controlling the spacing between the photoconductive surface and the developer roller. However, in the case of rigid photoconductive members, this is limited by the expense of reducing the tolerance accumulation between the photoconductive member and the developer roller.

With the increased usage of flexible photoconductive belts and magnetic brush developer rollers, it has become more feasible to control the spacing therebetween. When the photoconductive belt is maintained at the proper tensioning, it has now become practical to permit the developer material to space the photoconductive belt from the developer roller.

Various approaches have been devised to improve development. The following disclosures appear to be relevant:

U.S. Pat. No. 4,013,041; Patentee: Armstrong et al.; Issued: Mar. 22, 1977.

Research Disclosure Journal, July, 1979 Page 352, No. 18318; Disclosed By: Swapceinski.

Co-pending U.S. patent application Ser. No. 111,450; Filed: Jan. 11, 1980; Applicant: Kopko et al.

The pertinent portions of the foregoing disclosures may be briefly summarized as follows:

Armstrong et al. discloses an electrophotographic printing machine having a magnetic brush developer roller contacting one side of a flexible photoconductive belt. As shown in FIG. 3, guide rollers maintain a portion of the belt in a slackened condition so that the belt is capable of moving freely toward and away from the developer roller in response to the varying contours thereof.

Swapceinski describes an electrophotographic printing machine including a gimbled back-up roller engaging the backside of a photoconductive belt. The guide roller is opposed from the developer roller to compensate for relative changes in the thickness of the developer material on the developer roller, as well as maintaining constant pressure in the nip between the developer roller and photoconductive belt.

Kopko et al. describes an electrophotographic printing machine in which developer material on a developer roller deforms a tensioned photoconductive belt so as to space the developer roller from the belt.

In accordance with the features of the present invention, there is provided an apparatus for developing a latent image recorded on a flexible member with an insulating developer material. Means, positioned closely adjacent to the flexible member defining a development zone, transport the insulating developer material into contact with the flexible member in the development zone so as to develop the latent image recorded thereon. Means maintain the flexible member at a pre-selected tension of sufficient magnitude so that the insulating developer material being transported into contact therewith spaces the flexible member from the transporting means. Means are provided for adjusting the thickness of the insulating developer material being transported into the development zone to control the spacing between the flexible member and the transporting means so as to optimize development of lines and solid areas in the latent image.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
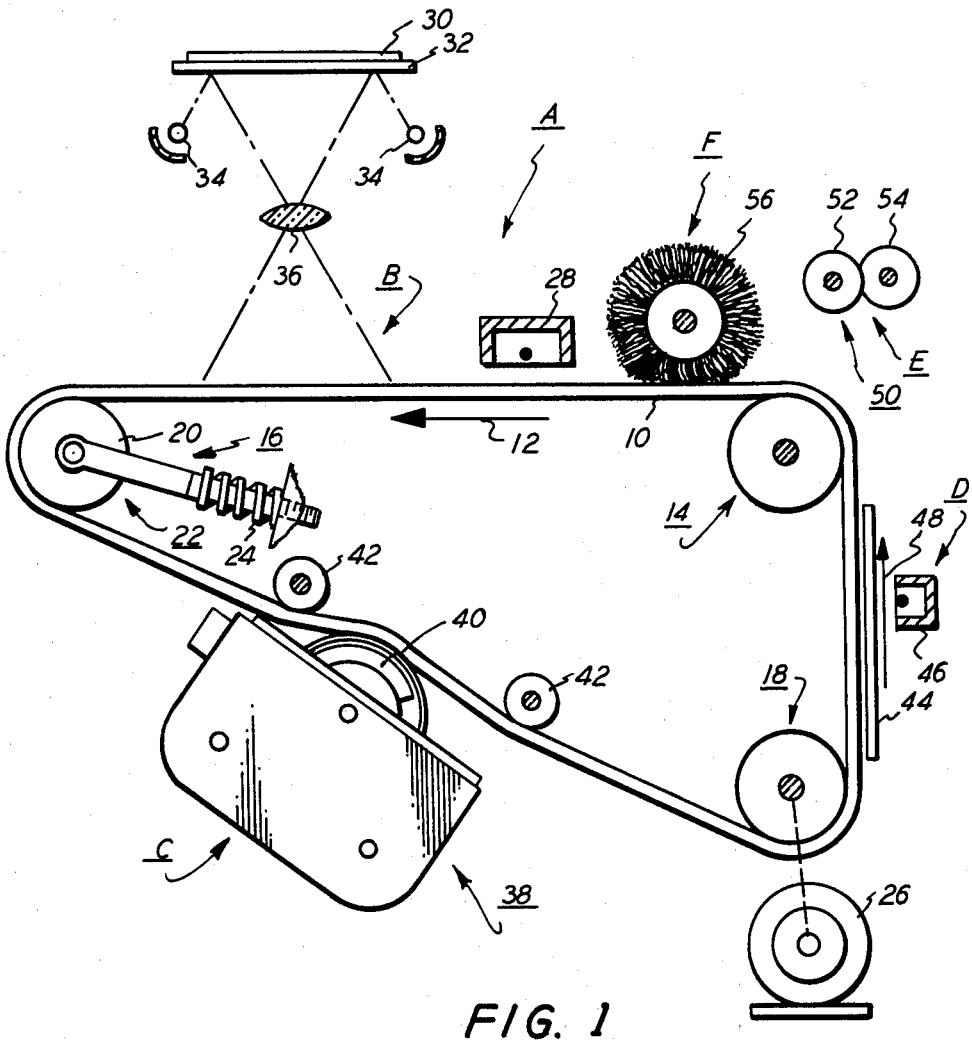
FIG. 1 is a schematic elevational view depicting an electrophotographic printing machine incorporating the features of the present invention therein.

For a general understanding of the illustrative electrophotographic printing machine incorporating the features of the present invention therein, reference is made to the drawings. In the drawings, like reference numerals have been used throughout to designate identical elements. FIG. 1 schematically depicts the various components of an electrophotographic printing machine employing the development system of the present invention therein. Although this development system is particularly well adapted for use in the illustrative electrophotographic printing machine, it will become evident from the following discussion that it is equally well suited for use in a wide variety of electrostatographic printing machines and is not necessarily limited in its application to the particular embodiment shown herein.

Inasmuch as the art of electrophotographic printing is well known, the various processing stations employed in the FIG. 1 printing machine will be shown hereinafter schematically, and their operation described briefly with reference thereto.

As shown in FIG. 1, the electrophotographic printing machine employs a belt 10 having a photoconductive surface deposited on a conductive substrate. Preferably, the photoconductive surface is made from a selenium alloy. The conductive substrate is made preferably from aluminum which is electrically grounded. Belt 10 moves in the direction of arrow 12 to advance successive portions of the photoconductive surface sequentially through the various processing stations disposed about the path of movement thereof. The path of movement of belt 10 is defined by stripping roller 14, tensioning system 16, and drive roller 18. As shown in FIG. 1, tension system 16 includes a roller 20 over which belt 10 moves. Roller 20 is mounted rotatably in yoke 22. Spring 24, which is initially compressed, resiliently urges yoke 22 in a direction such that roller 20 presses against belt 10. The level of tension is relatively low permitting belt 10 to be easily deflected. The detailed structure of the tensioning system will be described hereinafter with reference to FIG. 2. With continued reference to FIG. 1, drive roller 18 is mounted rotatably and in engagement with belt 10. Motor 26 rotates roller 18 to advance belt 10 in the direction of arrow 12. Roller 18 is coupled to motor 26 by suitable means such as a belt drive. Stripping roller 14 is freely rotatable so as to permit belt 10 to move in the direction of arrow 12 with a minimum of friction.

Initially, a portion of belt 10 passes through charging station A. At charging station A, a corona generating device, indicated generally by the reference numeral 28, charges the photoconductive surface of belt 10 to a relatively high, substantially uniform potential.

Next, the charged portion of the photoconductive surface is advanced through exposure station B. At exposure station B, an original document 30 is positioned face down upon transparent platen 32. Lamps 34 flash light rays onto original document 30. The light rays reflected from original document 30 are transmitted through lens 36 forming a light image thereof. Lens 36 focuses the light image onto the charged portion of the photoconductive surface to selectively dissipate the charge thereon. This records an electrostatic latent image on the photoconductive surface which corresponds to the informational areas contained within original document 30.

Thereafter, belt 10 advances the electrostatic latent image recorded on the photoconductive surface to development station C. At development station C, a magnetic brush development system, indicated generally by the reference numeral 38, advances an insulating developer material into contact with the electrostatic latent image. Preferably, magnetic brush development system 38 includes a developer roller 40. Developer roller 40 transports a brush of developer material comprising magnetic carrier granules and toner particles into contact with belt 10. As shown in FIG. 1, developer roller 40 is positioned such that the brush of developer material deforms belt 10 between idler rollers 42 in an arc with belt 10 conforming at least partially, to the configuration of the developer material. The thickness of the layer of developer material adhering to developer roller 40 is adjustable. When solid areas are being developed, the compressed pile height of the layer of developer material is about one-third of the compressed pile height for line development. The electrostatic latent image attracts the toner particles from the carrier granules forming a toner powder image on the photoconductive surface of belt 10. The detailed structure of magnetic brush development system 38 will be described hereinafter with reference to FIGS. 3 and 4.

After development, belt 10 advances the toner powder image to transfer station D. At transfer station D, a sheet of support material 44 is moved into contact with the toner powder image. Sheet of support material 44 is advanced to transfer station D by a sheet feeding apparatus (not shown). Preferably, the sheet feeding apparatus includes a feed roll contracting the uppermost sheet of the stack of sheets. The feed roll rotates so as to advance the uppermost sheet from the stack into a chute. The chute directs the advancing sheet of support material into contact with the photoconductive surface of belt 10 in a timed sequence so that the toner powder image developed thereon contracts the advancing sheet of support material at transfer station D.

Transfer station D includes a corona generating device 46 which sprays ions onto the backside of sheet 44. This attracts the toner powder image from the photoconductive surface to sheet 44. After transfer, sheet 44 moves in the direction of arrow 48 onto a conveyor (not shown) which advances sheet 44 to fusing station E.

Fusing station E includes a fuser assembly, indicated generally by the reference numeral 50, which permanently affixes the transferred toner powder image to sheet 44. Preferably, fuser assembly 50 includes a heated fuser roller 52 and back-up roller 54. Sheet 44 passes between fuser roller 52 and back-up roller 54 with the toner powder image contacting fuser roller 52. In this manner, the toner powder image is permanently affixed to sheet 44. After fusing, a chute guides the advancing sheet 44 to a catch tray for subsequent removal from the printing machine by the operator.

Invariably, after the sheet of support material is separated from the photoconductive surface of belt 10, some residual particles remain adhering thereto. These residual particles are removed from the photoconductive surface at cleaning station F. Cleaning station F includes a rotatably mounted fibrous brush 56 in contact with the photoconductive surface. The particles are cleaned from the photoconductive surface by the rotation of brush 56. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the features of the present invention therein.

Figure 2:
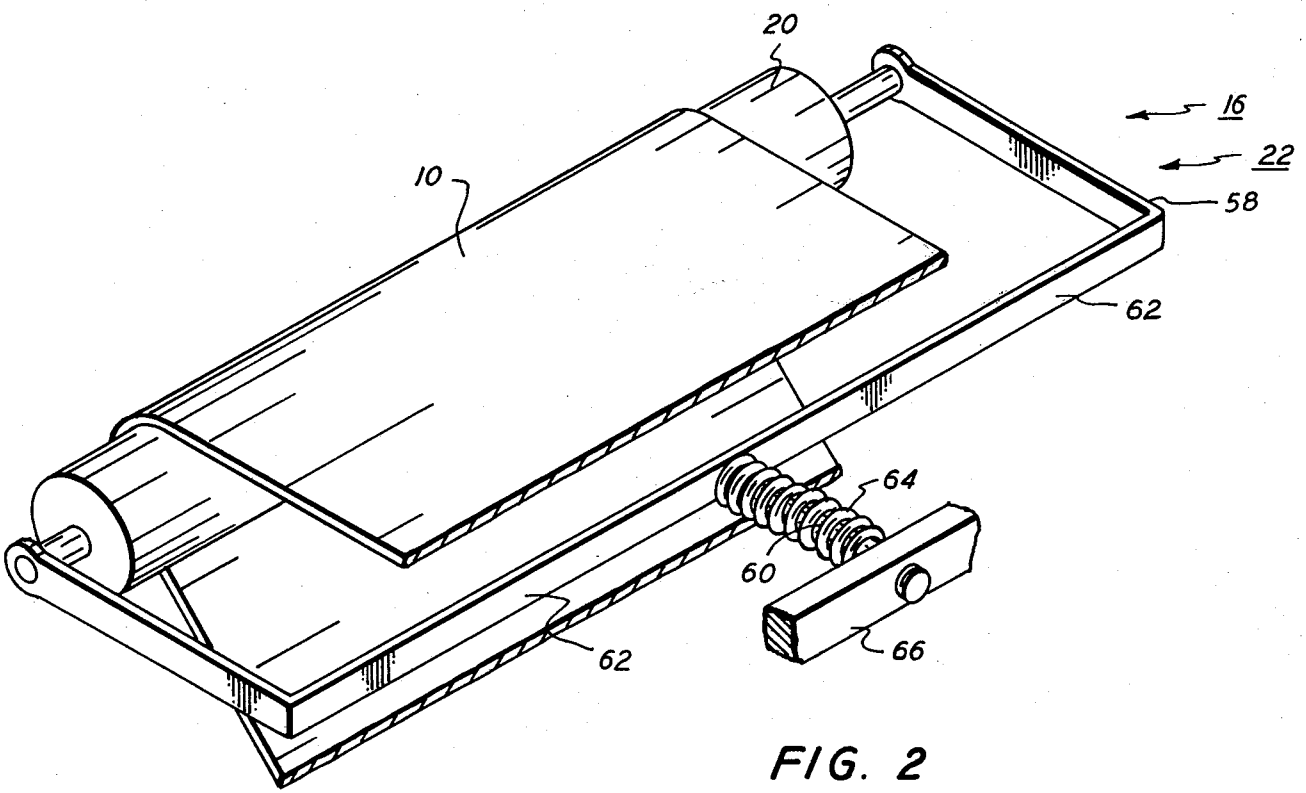
FIG. 2 is a fragmentary, perspective view showing the belt tensioning arrangement for the FIG. 1 printing machine.

Referring now to the specific subject matter of the present invention, FIG. 2 depicts tensioning system 16 in greater detail. As shown thereat, tensioning system 16 includes roller 20 having belt 10 passing thereover. Roller 20 is mounted in suitable bearings in a yoke, indicated generally by the reference numeral 22. Preferably, yoke 22 includes a U-shaped member 58 supporting roller 20 and a rod 60 secured to the mid-point of cross member 62 of U-shaped member 58. A coil spring 64 is wrapped around rod 60. Rod 60 is mounted slidably in the printing machine frame 66. Coil spring 64 is compressed between cross member 62 and frame 66. Compressed spring 64 resiliently urges yoke 22 and, in turn, roller 20 against belt 10. Spring 64 is designed to have the appropriate spring constant such that when placed under the desired compression,, belt 10 is tensioned to about 0.1 kilograms per linear centimeter. Belt 10 is maintained under a sufficiently low tension to enable the developer material on developer roll 40 to deform belt 10 through an arc ranging from about 10° to about 40°.

Figure 3:
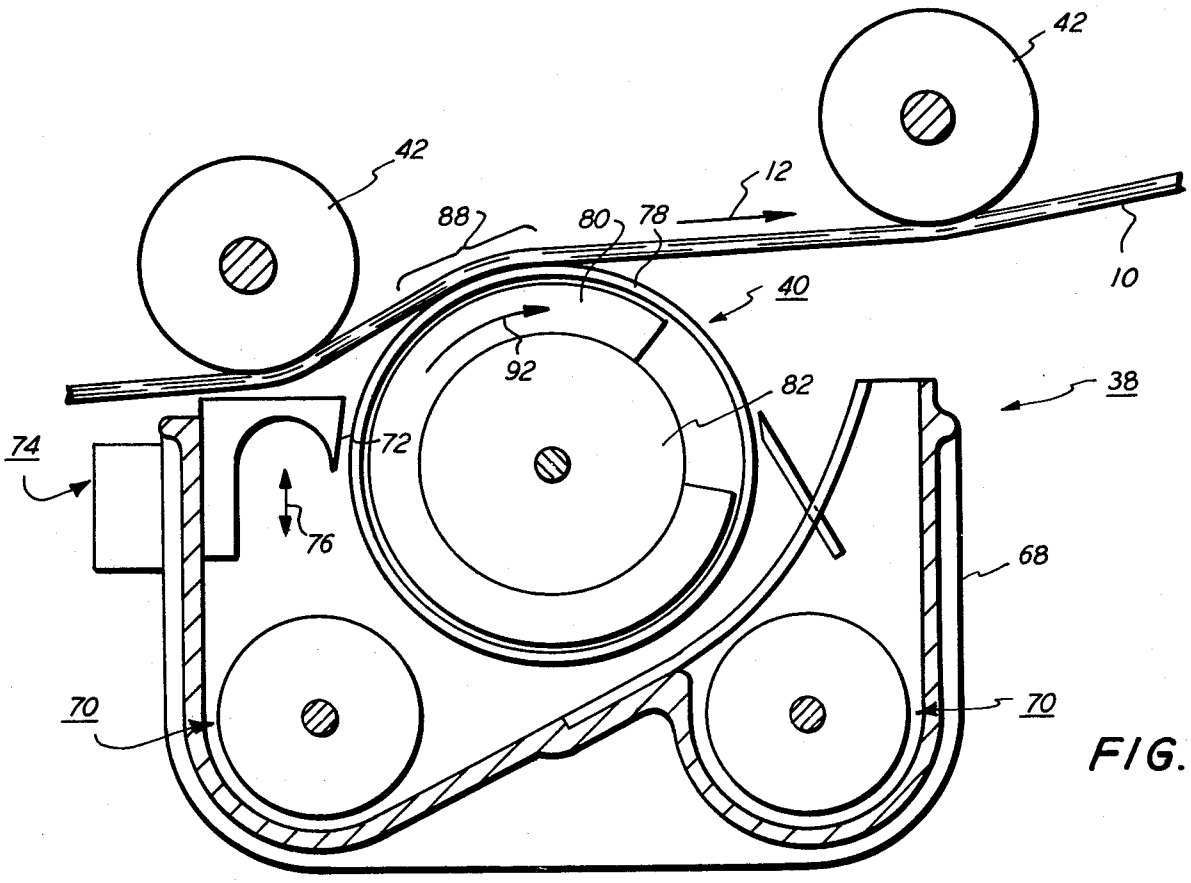
FIG. 3 is an elevational view illustrating the development system used in the FIG. 1 printing machine.

Turning now to FIG. 3, the detailed structure of development system 38 will be described. Development system 38 includes a housing 68 defining a chamber for storing and supply of developer material therein. A pair of augers 70 mix the developer material in the chamber of housing 60 and advance the developer material to developer roller 40. Developer roller 40 advances the insulating developer material into contact with the electrostatic latent image recorded on photoconductive belt 10. A movable trim bar 70 regulates the thickness of the developer pile height on developer roller 40. The tangential velocity of developer roller 40 is in the same direction and about two to three times the magnitude of the velocity of belt 10. The compressed pile height is about 0.050 centimeters for development of solid areas and about 0.180 centimeters for development of lines. A rack and gear assembly driven by a motor, shown generally by the reference numeral 74, is coupled to trim bar 72. The rack and gear assembly translates trim bar 72 in the direction of arrow 76. As trim bar 72 translates, the leading edge 78 thereof moves closer to and further away from the circumferential surface of developer roller 40. In this way, the thickness of the layer of insulating developer material adhering to developer roller 40 is suitably adjusted to regulate the compressed pile height of the developer material to the desired level. Trim bar 72 extends in longitudinal direction substantially across the width of developer roller 40 so as to provide a uniform gap controlling the quantity of material being moved into the development zone. Developer roller 40 includes a non-magnetic tubular member 78 preferably made from aluminum having the exterior circumferential surface thereon roughened. Elongated magnet 80 is positioned concentrically within tubular member 78 and mounted on shaft 82. Preferably, magnet 80 extends about 300° with exit zone 84 being devoid of magnetic material so as to permit the developer material to fall from tubular member 78 and return to the chamber of housing 68 for subsequent reuse. Blade 86 further assists in scrapping the unused developer material from tubular member 78.

Preferably, tubular member 78 is electrically biased by a voltage source (not shown) to a suitable polarity and magnitude. The voltage level is intermediate that of the background voltage level and the image voltage level recorded on the photoconductive surface of belt 10. By way of example, the voltage source electrically biases tubular member 78 to a voltage ranging from about 100 volts to about 500 volts. As tubular member 78 rotates at a constant angular velocity, a brush of developer material is formed on the peripheral surface thereof. The brush of developer material advances into contact with belt 10 in development zone 88. As previously indicated, the brush of developer material in development zone 88 deforms belt 10. The magnet 80 is mounted stationarily to attract the developer material to tubular member 78 due to the magnetic properties of the carrier granules having the toner particles adhering triboelectrically thereto. In the developing zone, these toner particles are attracted from the carrier granules to the latent image so as to form a toner powder image on the photoconductive surface of belt 10.

Figure 4:
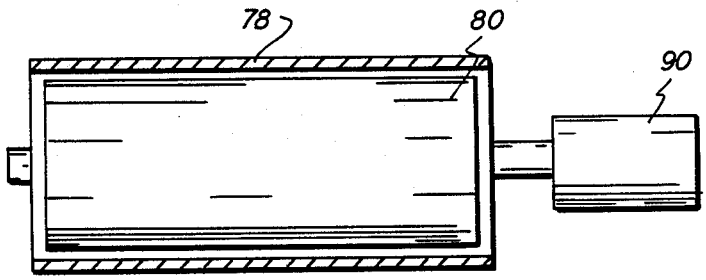
FIG. 4 is an elevational view depicting the developer roller of the FIG. 2 development system.

Turning now to FIG. 4, there is shown a drive system for developer roller 40. As illustrated thereat, magnet 80 is positioned concentrically and stationarily within tubular member 78. Tubular member 78 is coupled to motor 90. Preferably, motor 90 rotates tubular member 78 at a substantially constant angular velocity. Magnet 80 has the exterior circumferential surface thereof spaced from the interior circumferential surface of tubular member 78. In this way, the magnetic field generated by magnet 80 attracts the developer material to the exterior circumferential surface of tubular member 78. As motor 90 rotates tubular member 78 in the direction of arrow 92 (FIG. 3), the developer material is advanced into development zone 88. The advancing developer material contacts belt 10 and deforms belt 10 in an arc. In this way, the spacing between belt 10 and tubular member 78 is controlled by the compressed pile height of the developer material in development zone 78. Adjustment of the compressed pile height may be achieved by regulating the gap between the leading marginal edge portion of trim bar 72 and the exterior circumferential surface of tubular member 78.

By way of example, the insulating developer material has a resistivity ranging from about $10^{14}$ to about $10^{17}$ ohm-cm. Preferably, the developer material has a resistivity ranging from about $10^{14}$ to about $10^{17}$ ohm-centimeters. Preferably, the developer material comprises carrier granules having toner particles adhering triboelectrically thereto. The toner particles are made preferably from a thermoplastic material with the carrier granules being made preferably from a ferrite coated with a polymide resin. Other materials, such as polystyrenes, polyesters, or ethylene vinyl acetate copolymers may be used for the coating on the ferrite.

In recapitulation, it is clear that the development apparatus of the present invention includes a developer roller positioned closely adjacent to the photoconductive surface of the belt so as to transport insulating developer material into contact with the electrostatic latent image recorded thereon. The belt is maintained at a preselected tension of sufficient magnitude to enable the developer material to deflect the belt in the development zone. The compressed pile height of the developer material in the development zone is adjustable to optimize development of solid areas and lines in the latent image.

It is, therefore, evident that there has been provided in accordance with the present invention an apparatus for developing an electrostatic latent image that optimized development of lines and solid areas. This apparatus fully satisfies the advantages hereinbefore set forth. While this invention has been described in conjunction with a specific embodiment thereof, it is evident that many alternatives, modifications and variations will be apparant to those skilled in the art. Accordingly, it is intended to embrace all such alternatives, modifications and variations as fall within the spirit and broad scope of the appended claims.

What is claimed is:

1. An apparatus for developing a latent image recorded on a flexible member with an insulating developer material, including:

means, positioned closely adjacent to the flexible member defining a development zone therebetween, for transporting the developer material into contact with the flexible member in the development zone so as to develop the latent image recorded thereon;

means for maintaining the flexible member at a preselected tension of sufficient magnitude so that the developer material being transported into contact therewith spaces the flexible member from said transporting means; and means for adjusting the thickness of the developer material being transported into the development zone to control the spacing between the flexible member and said transporting means so as to optimize development of solid areas and lines in the latent image.

2. An apparatus according to claim 1, wherein the flexible member is a belt.

3. An apparatus according to claim 2, wherein said transporting means includes:

a tubular member journaled for rotary movement;

means for attracting the developer material to said tubular member; and means for rotating said tubular member to transport the developer material into contact with the latent image in the development zone.

4. An apparatus according to claim 3, wherein said adjusting means includes:

a blade member having the leading edge thereof positioned adjacent said tubular member to define a gap therebetween; and means for moving said blade member to adjust the gap so as to control the thickness of the developer material being transported into the development zone.

5. An apparatus according to claim 4, for developing a latent image with insulating developer material having magnetic particles, wherein:

said tubular member is non-magnetic; and said attracting means includes an elongated magnet disposed interiorally of and spaced from said tubular member.

6. A method of developing a latent image recorded on a flexible member, including the steps of:

transporting an insulating developer material into contact with the flexible member in a development zone so as to develop the latent image recorded thereon;

maintaining the flexible member at a pre-selected tension of sufficient magnitude so that the developer material being transported into contact therewith spaces the flexible member from the developer material transport; and adjusting the thickness of the developer material being transported into the development zone to control the spacing between the flexible member and the development material transport so as to optimize development of solid areas and lines in the latent image.

7. A method according to claim 6, wherein said step of transporting includes the steps of:

attracting the developer material to a tubular member; and rotating the tubular member to transport the developer material attracted thereto into contact with the latent image.

8. A method according to claim 7, wherein said step of adjusting includes the step of positioning the leading edge of a blade relative to the tubular member to define one gap therebetween for development of lines in the latent image and another gap therebetween for development of solid areas in the latent image.

* * * * *